US010829989B2

(12) United States Patent
Rejc

(10) Patent No.: US 10,829,989 B2
(45) Date of Patent: Nov. 10, 2020

(54) MOTOR-OPERABLE AND VERTICALLY MOVABLE GATE

(71) Applicant: Gabrijel Rejc, Landshut (DE)

(72) Inventor: Gabrijel Rejc, Landshut (DE)

( * ) Notice: Subject to any disclaimer, the term of this patent is extended or adjusted under 35 U.S.C. 154(b) by 379 days.

(21) Appl. No.: 15/739,598

(22) PCT Filed: Jun. 26, 2017

(86) PCT No.: PCT/EP2017/065623
§ 371 (c)(1),
(2) Date: Dec. 22, 2017

(87) PCT Pub. No.: WO2018/001924
PCT Pub. Date: Jan. 4, 2018

(65) Prior Publication Data

US 2018/0313140 A1 Nov. 1, 2018

(30) Foreign Application Priority Data

Jun. 28, 2016 (EP) ..... 16176550

(51) Int. Cl.
*E06B 9/15* (2006.01)
*E05D 15/24* (2006.01)
(Continued)

(52) U.S. Cl.
CPC ..... *E06B 9/15* (2013.01); *E05D 15/242* (2013.01); *E05F 15/684* (2015.01); *E06B 9/171* (2013.01);
(Continued)

(58) Field of Classification Search
CPC ... E06B 9/15; E06B 9/581; E06B 9/56; E06B 9/58; E06B 2009/1533; E06B 2009/155;
(Continued)

(56) References Cited

U.S. PATENT DOCUMENTS 1,416,071 A 5/1922 Smurr
1,942,320 A 1/1934 Young
(Continued)

FOREIGN PATENT DOCUMENTS

CN 2122972 U 11/1992
CN 2157356 Y 2/1994
(Continued)

OTHER PUBLICATIONS

EP161765490.0 European Search Report dated Nov. 9, 2016, 9 pages.
(Continued)

*Primary Examiner* — Johnnie A. Shablack
(74) *Attorney, Agent, or Firm* — Hahn Loeser & Parks LLP; Bret A. Hrivnak

(57) ABSTRACT

The present invention relates to a gate with a gate panel, comprising several gate panel sections which are hingedly coupled to each other by way of hinges, where a hinge comprises two hinge panels of adjacent gate panel sections, at least one elongate drive means which is connected to at least one gate panel section, and at least one guide means which is suitable to guide the gate panel during its motion. In order to optimize the gate with regard to its installation space, in particular in the width and depth direction, and to ensure simple and inexpensive yet at the same time still reliable operation of the gate, it is proposed to arrange the elongated drive means at least in sections received in the gate panel section.

13 Claims, 16 Drawing Sheets

Figures 1, 2:
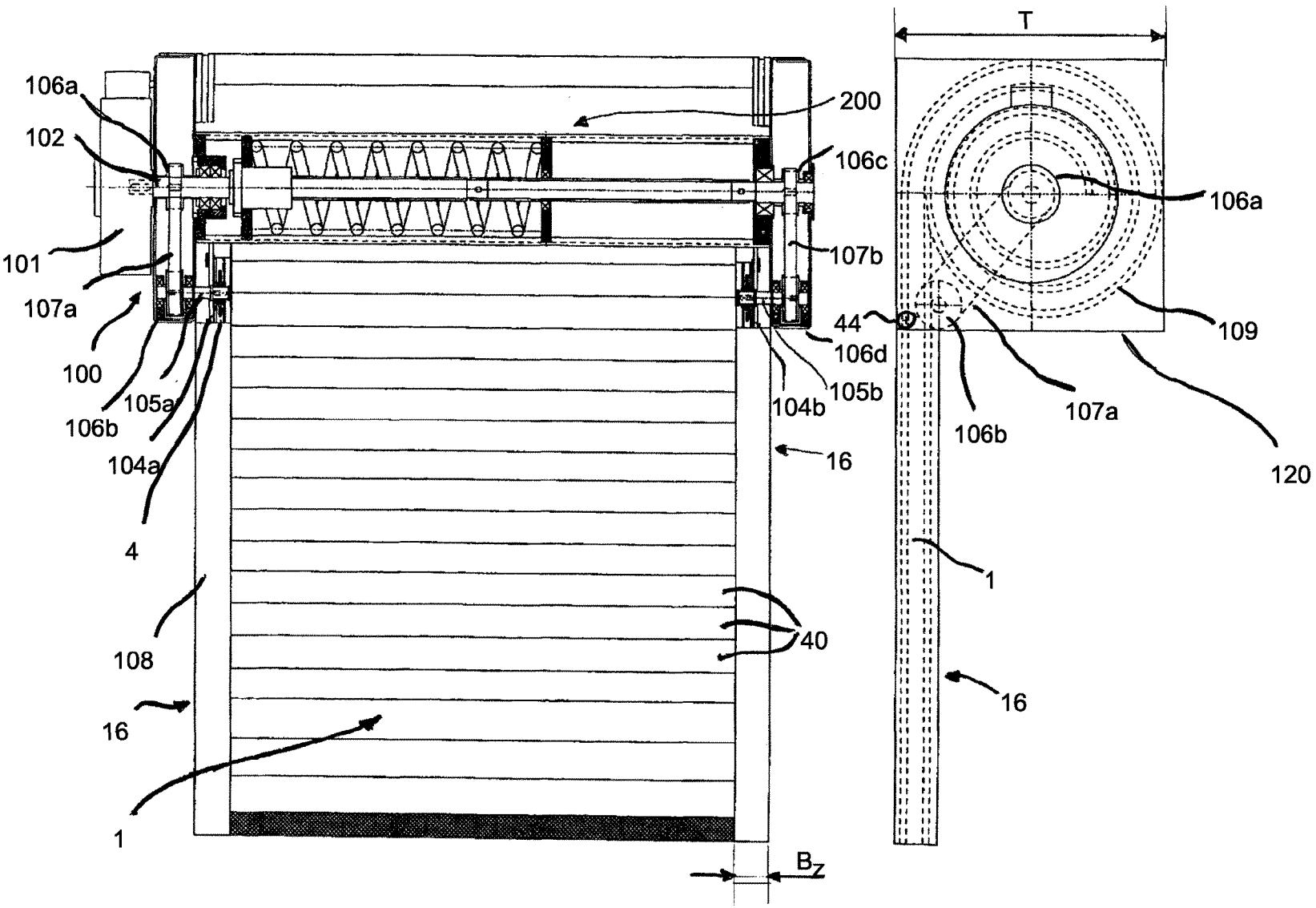

(51) Int. Cl.

| | |
|---|---|
| ***E06B 9/58*** | (2006.01) |
| ***E05F 15/684*** | (2015.01) |
| ***E06B 9/171*** | (2006.01) |
| *E06B 9/90* | (2006.01) |
| *E06B 9/68* | (2006.01) |
| *E06B 9/62* | (2006.01) |
| *E06B 9/70* | (2006.01) |

(52) U.S. Cl.
CPC ..... *E06B 9/581* (2013.01); *E05Y 2900/106* (2013.01); *E06B 9/582* (2013.01); *E06B 9/62* (2013.01); *E06B 9/68* (2013.01); *E06B 9/70* (2013.01); *E06B 9/90* (2013.01); *E06B 2009/1555* (2013.01); *E06B 2009/1566* (2013.01); *E06B 2009/1583* (2013.01); *E06B 2009/588* (2013.01); *E06B 2009/6836* (2013.01); *E06B 2009/6845* (2013.01); *E06B 2009/6872* (2013.01)

(58) Field of Classification Search
CPC ..... E06B 2009/1555; E06B 2009/1566; E06B 2009/1577; E06B 2009/1588; E06B 2009/1583; E06B 2009/1505; E06B 2009/583; E06B 2009/588; E05F 15/684; E05F 15/686; E05F 15/681; E05D 15/24; E05D 15/242
See application file for complete search history.

(56) References Cited

U.S. PATENT DOCUMENTS 2,055,511 A 9/1936 Twiss
2,844,843 A 7/1958 Logan
3,007,194 A 11/1961 Griswold
4,119,133 A * 10/1978 Wolf ..... E05D 15/246 160/201
4,126,173 A * 11/1978 Theuerkauff ..... E06B 9/08 160/229.1
4,811,777 A * 3/1989 Chretien ..... E06B 9/13 160/189
4,986,331 A * 1/1991 Henkenjohann ..... E06B 9/11 160/201
5,065,806 A * 11/1991 Kondoh ..... E06B 9/0638 160/36
5,188,161 A * 2/1993 Erber ..... E06B 7/086 160/133
5,377,738 A * 1/1995 Cooper ..... E06B 9/15 160/133
5,394,924 A * 3/1995 Rejc ..... E05D 15/24 160/201
5,484,007 A * 1/1996 Rejc ..... E06B 3/485 160/133
5,488,982 A 2/1996 Rejc
5,535,805 A * 7/1996 Kellogg ..... E05D 15/165 16/87 R
5,551,535 A 9/1996 Krolo et al.
5,566,737 A * 10/1996 Erber ..... E06B 9/34 160/133
5,711,113 A 1/1998 Nygaard
5,829,504 A * 11/1998 Ekstrand ..... E05D 15/165 160/201
5,831,403 A 11/1998 Kanki et al.
6,041,844 A * 3/2000 Kellogg ..... E05D 15/165 16/87 R
6,042,158 A 3/2000 Horn
6,092,338 A 7/2000 Crowner et al.
6,123,139 A * 9/2000 Kalempa ..... E05D 15/165 160/133
6,137,251 A 10/2000 Huang et al.
6,172,475 B1 1/2001 Fitzgibbon et al.
6,289,966 B1 9/2001 Hoermann
6,330,903 B1 12/2001 Weinreich
6,427,749 B1 * 8/2002 Swink ..... B60J 5/08 160/133
6,672,362 B1 * 1/2004 Mullet ..... E05D 15/165 16/225
6,920,718 B2 7/2005 Hom et al.
6,928,696 B2 * 8/2005 Wartman ..... E05D 15/24 16/106
7,064,505 B2 6/2006 Sato
7,208,897 B2 4/2007 Hotto et al.
7,212,897 B2 5/2007 Suzuki et al.
7,723,936 B2 5/2010 Schaefer
7,798,198 B2 * 9/2010 Rejc ..... E06B 9/08 160/133
7,913,739 B2 * 3/2011 Rejc ..... E06B 9/08 160/133
7,941,972 B2 5/2011 Kamiya et al.
8,011,414 B2 * 9/2011 Levy ..... E06B 9/34 160/116
8,026,809 B2 9/2011 Schaefer et al.
8,169,169 B2 5/2012 Hass et al.
8,899,297 B2 12/2014 Mazej et al.
8,991,275 B2 3/2015 Ishikawa
9,243,685 B2 * 1/2016 Hawkins ..... E05F 15/684
9,267,326 B2 * 2/2016 Gomaa ..... E06B 9/70
9,416,579 B2 8/2016 Rejc
9,487,986 B2 * 11/2016 Okachi ..... E06B 9/54
9,624,708 B2 * 4/2017 Balay ..... E05D 15/165
9,803,420 B2 * 10/2017 Ronchetti ..... E06B 9/15
9,915,094 B2 * 3/2018 Frede ..... E06B 9/17
10,012,015 B2 7/2018 Rejc
10,053,901 B2 * 8/2018 Schweiss ..... E05D 15/264
10,190,362 B2 * 1/2019 Fischer ..... E06B 9/0638
10,253,557 B2 * 4/2019 Frede ..... E06B 9/15
10,344,527 B2 * 7/2019 Balbach ..... E06B 9/58
2003/0047291 A1 3/2003 Klein
2004/0173326 A1 * 9/2004 Dittmer ..... E05D 15/242 160/201
2004/0183677 A1 9/2004 Fitzgibbon
2005/0126720 A1 * 6/2005 Rekret ..... E05F 15/67 160/201
2006/0162876 A1 7/2006 Kwak
2007/0062650 A1 * 3/2007 Rejc ..... E06B 9/08 160/133
2008/0210386 A1 * 9/2008 Neuhaus ..... E06B 9/08 160/133
2011/0146920 A1 * 6/2011 Mazej ..... E06B 9/08 160/311
2011/0271595 A1 11/2011 Eggeling et al.
2014/0117757 A1 5/2014 Tsui et al.
2014/0332172 A1 11/2014 Hsieh
2015/0300084 A1 * 10/2015 Schonerwald ..... E06B 9/15 160/133
2015/0322703 A1 11/2015 Matsuo
2015/0368962 A1 * 12/2015 Motosko ..... E06B 9/581 160/107
2016/0348429 A1 * 12/2016 Frede ..... E06B 9/88
2017/0009524 A1 * 1/2017 Dwarka ..... E06B 9/24
2018/0073296 A1 * 3/2018 Chen ..... E06B 9/52
2018/0258689 A1 9/2018 Rejc
2018/0313140 A1 11/2018 Rejc
2019/0390511 A1 * 12/2019 Lambridis ..... E06B 9/70

FOREIGN PATENT DOCUMENTS

CN 103775561 A 5/2014
DE 7426752 U 5/1975
DE 2542801 A1 4/1976
DE 2935490 A1 3/1981
DE 4015214 A1 11/1991
DE 19831806 A1 1/1999
DE 19952038 A1 10/2000
DE 10011789 A1 9/2001
DE 20112771 U1 12/2001
DE 10232577 A1 2/2004
DE 60309310 T2 5/2007
DE 102006033708 A1 8/2007
DE 102009044492 5/2011
DE 102012101415 B3 3/2013

(56) References Cited

FOREIGN PATENT DOCUMENTS

| | | | |
|---|---|---|---|
| DE | 202012012514 | U1 | 6/2013 |
| EP | 0056650 | A2 | 1/1982 |
| EP | 0128391 | A | 7/1985 |
| EP | 808985 | A2 | 11/1997 |
| EP | 0945575 | A2 | 9/1999 |
| EP | 1816307 | A1 | 8/2007 |
| EP | 1882802 | A2 | 1/2008 |
| EP | 2148040 | A1 | 1/2010 |
| EP | 2887535 | A1 | 6/2015 |
| GB | 570469 | A | 7/1945 |
| GB | 746253 | A | 3/1956 |
| GB | 1013644 | | 12/1965 |
| GB | 2141171 | A | 12/1984 |
| JP | H07-006491 | U | 1/1995 |
| JP | H07-023191 | U | 4/1995 |
| JP | 2007177430 | A | 7/2007 |
| JP | 2008261182 | A | 10/2008 |
| JP | 2008291546 | A | 12/2008 |
| JP | 2012500347 | A | 1/2012 |
| WO | 9839542 | A1 | 9/1998 |
| WO | 20091125562 | A1 | 9/2009 |
| WO | 2015144729 | A1 | 10/2015 |

OTHER PUBLICATIONS

PCT/EP2017/065622 International Search Report dated Sep. 26, 2017, 6 pages.

PCT/EP2017/079330—International Search Report and Written Opinion dated Mar. 1, 2018, 11 pages.

PCT/EP2017/083109—International Search Report and Written Opinion dated Apr. 9, 2018, 13 pages.

International Search Report for application PCT/EP2017/065623, dated Sep. 28, 2017.

European Search Report for application EP16176550.8, dated Oct. 18, 2016.

* cited by examiner

T
106a
109
120
107a
106b
1
16

200
106c
107b
44
106d
105b
104b
16
40
Bz
106a
102
101
107a
100
106b
105a
104a
4
108
16
1

MOTOR-OPERABLE AND VERTICALLY MOVABLE GATE

The invention relates to a motor-operable and vertically movable lifting gate according to the preamble of claim 1.

Lifting gates of this type are used for opening and closing passages. They are frequently used as garage doors or, for example, as gates for supply ramps. However, they are also used as room dividers in warehouses. Since these gates are often very heavy, they are usually driven primarily by a motor.

Such a motor drive usually comprises at least one motor which is connected to the gate via drive mechanisms, such as drive belts or drive chains. Furthermore, transmissions are generally used, depending on the desired rotational speed and the torque of the motor. In this way, high-speed gates used in the industry can be realized. In so-called high-speed gates, gate panel speeds of up to 4 m/s can be reached, whereas the gate panels of conventional industrial lifting gates are moved at speeds of typically 0.2-0.3 m/s.

Gates of the type above-mentioned are known, for example, from DE 40 15 214 A1, in which a lifting gate with a slatted armor and an electric drive with an electric motor and a laterally revolving drive chain is disclosed. This lifting gate comprises two guide tracks which are arranged on the two opposite sides of the gate opening, as well as a slatted armor consisting of individual slats, where a hinge strap is arranged laterally on each slat. The hinge straps are supported and guided in the guide tracks. The individual hinge straps are connected to each other and thereby form the support frame of the slatted armor, where said support frame absorbs all the forces arising during movement of the lifting gate. In the region of a lower slat, the laterally revolving chain is attached to the slatted armor by way of a bracket.

Operation of the gate by use of a drive chain acting on the lowermost gate panel segment offers the advantage that even large and heavy gates can be reliably operated. Furthermore, since the chain can be accommodated laterally at the gate within the gate frame, it is well protected from external influences. However, the gate frames must provide sufficient space, in particular, in the installation width. Asynchronous motors are used to drive this chain, which are simple to handle and inexpensive to purchase. The motors are installed in a space-saving manner in the region of the gate lintel. However, asynchronous motors generally require additional components such as frequency converters, emergency stop devices like disk brakes or pawls, and external gears. These components, in particular, the emergency stop devices, are also installed in the region of the gate lintel. Therefore, a correspondingly large installation space is necessary with regard to the installation depth. Overall, such gates therefore require sufficient space both in the direction of the width and the depth.

In order to optimize the installation space, WO 2009/112 562 A1 firstly proposes to use torque motors with control and power regulator units. The gears can then be dispensed with, so that the required installation space in the lintel region of the lifting gate can be reduced. The installation space is there advantageously saved in the installation depth direction. For further optimization of the installation space, this publication also proposes replacing laterally revolving drive chains with a direct drive connected to the gate shaft. The motor is there connected directly to a gate shaft. The upper end of the gate panel, in turn, is connected to the gate shaft. The motor rotates the gate shaft in order to lift and lower the gate panel, where the gate panel attached to the gate shaft is wound onto the shaft or wound from the shaft.

By dispensing with the chains running laterally in the gate frames, the installation dimensions of the gate frames, i.e. the installation width, can be reduced.

In order to save installation space and the mass of the gate to be moved, DE 199 52 038 A1 proposes to attach the end of a rope or a chain firmly to the gate lintel for moving the sectional gate and to wind a second end onto a drum or to convey it into a guide rail by use of a sprocket. The chain is run over a deflection roller on the lowermost gate section, so that winding or conveying the rope or chain leads to the gate opening or closing. Rollers are provided for horizontal guidance of the gate, where the rope or the chain extends between the rollers and the sections of the gate.

Accordingly, it is an object of the invention to provide a motor-operable lifting gate which is optimized in terms of the installation space, in particular, in the direction of the width and the depth, and thereby ensuring simple and inexpensive but simultaneously reliable operation of the lifting gate.

This object according to the invention is satisfied by a lifting gate having the features of the characterizing part of claim 1.

Due to the accommodated arrangement of the elongate drive means in the gate panel sections, saving installation space as well as a favorable force and motion coupling of the gate panel can be achieved with the elongate drive means. The width that is used to drive the gate is small. Since the drive means and the guide means are generally located within the lateral gate frames, the installation width of the gate frames can be kept small. The gate panel sections and the elongate drive means are arranged spatially together so that a favorable transmission of forces between the drive means and the gate panel is ensured when the gate panel is raised.

According to a further development of the invention, the elongate drive means can be a finite drive means and/or a chain. With a finite drive means, its return on the side of the return span and a deflection roller at the lower end of the gate can be dispensed with, whereby installation space can be saved. A chain serving as a drive means represents a particularly advantageous embodiment of a drive means for such gates due to its minor change in length during operation. Furthermore, the relatively constant length of a chain allows for precise control of the position of the gate.

In one variant, at least one gate panel section can have a gate panel segment and a hinge panel, and the elongate drive means can be implemented at least in sections between at least one gate panel segment and at least one guide means. This arrangement enables saving installation space. By arranging the drive means between the guide elements and the gate panel segments, in particular the gate frame width can be reduced. When the drive means is arranged closer to the gate panel segment than the guide means, lever effects, occurring between the point of engagement of the drive means and the center of gravity of the gate panel when the gate is opened, can be kept small.

A connection mechanism can possibly be provided which connects a gate panel segment to the elongate drive means and a guide means. As a result, the most direct connection between the drive means and the gate panel segment is realized. On the other hand, the connection mechanism can in this manner be connected to the gate panel segment in the shortest possible way, so that installation space can be saved with respect to the gate frame width.

According to one development, the connection mechanism can extend through two hinge panels and serve as hinge pins. Since the connection mechanism ensures both the connection between two hinge panels and also connects a gate panel section with the drive means and thereby fulfills several tasks for the gate, a structure with very few components and low complexity is made possible.

In one advantageous embodiment, the guide means can have a guide roller which is rotatably mounted on the connection mechanism and which, in particular, has a shoulder. Such a roller can guide the gate panel in the frame during an opening and closing motion. The guide roller allows for reduction of the friction occurring when the gate panel sections are guided and the wear resulting therefrom. The connection mechanism serves as an axis of rotation for the guide roller, whereby components can be saved and the configuration is simplified. A shoulder can further improve the guide properties of the guide roller, especially in several directions. In situations, in which external forces act on the gate panel, such as wind force, this can result in individual gate panel segments being pressed out of the gate frame in an approximately horizontal direction. A guide roller comprising a shoulder can counteract this.

It is conceivable to have several gate panel sections each connected individually to the drive means. The force required to operate the gate can thereby advantageously be distributed over several individual gate panel segments. The individual connection elements can be of small dimensions, corresponding to the reduced forces.

According to one development of the invention, at least one hinge panel can be configured in combination with the drive means. In this way, the tasks of the hinge panels and the drive means can at least in part be co-assumed by the respective other one or can be fulfilled by both elements in interaction. Furthermore, the combination of the drive means and the hinge panels makes it possible to improve transmission of forces and coupling of motions between these elements.

Advantageously, at least one gate panel section can comprise a recess for accommodating the drive means, where the recesses of the individual gate panel sections can be arranged approximately aligned with one another. The recesses provided in the individual hinge panels can then provide a kind of channel for the drive element, where this channel is able to be used for receiving and guiding as well as protecting the drive means against external influences, such as, for example, external mechanical force.

It is conceivable that the drive means can bear against at least one surface of a recess, where the movability of the drive means can be limited by the recess approximately transversely to the direction of motion of the gate panel. Due to the limited movability of the drive means, its position relative to the gate panel can be better defined and the force coupling between the gate panel and the drive means can thus be improved, which promotes a more stable and smooth upward and downward motion of the gate.

In a particular manner, a damper can be provided between the drive means and at least one surface of a gate panel section and be suitable for damping a relative motion between the drive means and the hinge panel (German: "Scharniergewerbe"). Such a damper can limit the movability of the drive means relative to the hinge panel and thereby, firstly, reduce the formation of noise and, secondly, reduce the wear caused by a collision of the drive means with the hinge panel when the gate panel is opened and closed.

According to one embodiment of the invention, a sliding element, in particular a sliding disk, can be arranged between at least one surface of a gate panel profile and at least one hinge panel, where said sliding disk can be mounted in particular on the connection mechanism. The sliding element guides the gate panel transversely relative to its opening and closing motion. Possible friction-induced wear may occur to some degree at the sliding disks and to a lesser degree at other components of the device. In particular, the connection element acts as a bearing for the sliding element and allows for favorable positioning of the sliding element close to the location of the transmission of forces between the drive element and the gate section. In one development, a hinge panel comprise at least one lateral guide element which is suitable for moving the hinge panel in the direction approximately transverse to an opening or closing motion of the gate panel. Correct guidance of the entire gate panel during a vertical motion can thereby be ensured, which contributes to good operability of the gate.

Optionally, the respective hinge panel can be arranged at least in part in a cavity of the respective gate panel segment and can be connected substantially to the respective gate panel segment within this cavity, where the respective hinge panel and the respective gate panel segment are connected to one another, in particular, by adhesive bonding. This arrangement of the hinge panel in a cavity of the gate panel segment offers the advantage that the hinge panel is at least in part arranged within the gate panel segment, which leads to a compact configuration of the gate. In addition, a sufficiently large area is available for adhesively bonding the two parts.

Advantageously, at least one hinge panel can be connected to a gate panel segment by way of a screw connection, where in particular the gate panel segment can comprise at least one bore with a thread and the hinge panel at least one through bore, through which a screw can extend. The screw connection is a favorable and reliable type of connection, which also makes it possible to dismantle the gate panel segments from the hinge panels (German: "Scharniergewerbe") and to replace them, depending on the field of application, whereby the gate panel can be adapted with less effort to different tasks.

According to one embodiment, a drive element, in particular a sprocket, can engage with the drive means and a guide can be provided which holds the elongate drive means in engagement with the elongate drive means in the region of the drive element. The interaction of the drive element and the guide can ensure reliable engagement of the drive element with the drive means and thereby reliable transport of the gate panel. In particular, when a chain is used as the drive means, a sprocket is suitable as its drive.

According to one development, the drive element can extend at least in part into the recess. Where a gate panel section comprises a recess in which the drive means is accommodated, this ensures reliable engagement of the drive element with the drive means. Furthermore, due to such an arrangement, the drive element can be placed close to the gate panel sections and installation space can thus be saved.

The guide can optionally have at least one counter bearing which forces the elongate drive means in the direction of the drive element and is, in particular, suitable for engaging with a hinge panel. As a result, the engagement between the drive means and the drive element can be further improved. When the hinge panel is coupled to the drive means, the counter bearing can act favorably on the drive means when the hinge panel is engaged.

According to one embodiment, the guide can comprise at least one retaining roller which is, in particular, suitable for rolling engagement with a hinge panel. Any friction possibly arising between the guide and the movable components of the gate can be reduced by the retaining roller, which leads to less energy being required for movement of the gate panel and to less wear.

In addition, further advantageous embodiments of the present invention are conceivable.

Advantageously, the hinges can be arranged laterally on the gate panel segments. In such lateral arrangement of the hinges, it can be ensured that the hinges do not obstruct the rolling process, for example, when the gate panel is rolled up. In addition, this reduces the risk of the hinges damaging the layer respectively rolled up therebeneath when the gate panel is rolled up.

It is conceivable that the drive means can be actuated by an electric motor, in particular by a synchronous motor, which can be down-regulated to zero rotational speed. With such a motor, complex configurations of mechanical safety brake devices can be dispensed with. In addition, only a few to no additional external components, such as gears, are required. For installation in the region of the gate lintel, such a motor can therefore be accommodated in a comparatively small space. The installation depth of the gate can therefore be kept small.

Furthermore, it is advantageous if the control unit, upon the occurrence of a stop condition, is adapted to actuate the drive motor such that its rotational speed is reduced in a controlled manner and the gate panel is thereby braked in a motor-driven manner, where the drive motor is configured to provide sufficient torque at zero rotational speed to hold the gate panel at a current position. This is applicable, in particular, in emergency situations where the gate must usually be decelerated abruptly. Since, for example, asynchronous motors do not provide adequate torque for holding the gate, a mechanical emergency brake system must additionally be installed. When using the proposed motor, it is possible to dispense with complex mechanical systems requiring large installation space, so that installation space can be saved in the region of the gate lintel, i.e., in the installation depth direction.

In one possible embodiment of the invention, the drive motor can comprise an output shaft which is connected to the drive means by way of an additional force transmission mechanism, in particular, by way of a belt or a chain. By way of such a deflection, the drive can be stepped up or stepped down in a tight space In addition, weight compensation can thereby be actuated together with the drive means in a simple manner by the same motor.

It is conceivable that drive motors are provided on both sides on the lifting gate. They can preferably be provided on both sides in the region of the gate lintel. The division of force to be applied to two motors reduces the required size of the respective motors as compared to only one motor. By using smaller motors, installation space can be saved in a simple manner, in particular, in the region of the gate lintel, i.e. in the installation depth direction.

It is also conceivable that drive means are provided on both sides on the lifting gate. The division of force to be applied to two drive means reduces the required size of the respective drive means as compared to only one drive means. In that the drive means has smaller dimensions, installation space can be saved, in particular, in the region of the gate frame, i.e. in the installation width direction.

In one possible embodiment, a weight compensation device can be provided, where the drive motor actuates this weight compensation device. The weight compensation device can therefore also be actuated by the drive motor for driving the gate panel. By omitting an additional motor, installation space can be saved, in particular, in the region of the gate lintel, i.e. regarding the installation depth.

Furthermore, it is proposed that a hinge panel of a hinge has at its one end a fixed bearing and at its opposite end a floating bearing. This realizes a bearing location with a rotational as well as a bearing location with a rotational and translational degree of freedom, so that a destruction-free length change between two hinge panels is made possible in a particularly advantageous manner.

It is also conceivable that the individual hinge panels can be connected to one another and form a hinge chain. With such a hinge chain, the individual gate panel segments can be easily combined into a common stable gate panel, where the individual gate panel segments can be configured as having a lightweight design.

In one possible embodiment of the invention, the respective hinge panel can be arranged on an end side on the face side of the respective gate panel segment facing the gate frame. In addition, the respective hinge panel can extend approximately over the entire height of the respective gate panel segment. A particularly simple embodiment of the individual hinge panels can be realized in this manner, for example, as a simple injection-molded member. Extension of the hinge panel over approximately the entire height of the gate panel segment offers the advantage that a large connecting surface is provided between the gate panel segment and the hinge panel, so that a good connection can be realized.

It is proposed that the connection mechanism is connected to the respective gate panel segment in the upper half of a gate panel segment, and in particular, in the region of an upper edge of the gate panel segment. Since the connection mechanism is located in the upper half, i.e. above the pivot axis of the gate panel segment, a suspended support structure is implemented, where a gate panel segment is suspended from the connection mechanism following gravity. The individual gate panel segments are thus pulled by the drive means during a vertical motion of the gate panel, which leads to tautening the individual gate panel segments among each other, thereby improving the stability as well as the operability and the durability of the gate.

The drive motor can advantageously be coupled to the gate panel directly, in particular, without gearing. This reduces structurally complex gearing units prone to wear and defect.

In a further favorable embodiment, the drive system further comprises an electrical energy storage, preferably in the form of an accumulator unit that is adapted to supply the drive motor and the control unit with electrical energy in case of power failure. Advantageously, the control unit can there be configured to detect power failure and to interpret this as an emergency condition so that the drive motor is capable of reducing the speed and holding the gate panel at a standstill in the event of power failure. Weight-counterbalancing the gate panel can also be dispensed with in this manner.

The synchronous drive can optionally be configured such that it can move the gate panel even without the use of weight counterbalancing systems. At the same time, the power regulation of the synchronous drive can recuperate the freed energy released during braking and/or when the gate is closed, for example, in a rechargeable accumulator unit or a capacitor unit. The design complexity associated with the weight counterbalancing systems can therefore also be reduced without increasing the load on mechanical supports or compromising safety.

In addition, the control unit can further be adapted to enable an emergency operation of the lifting gate in the event of power failure, in particular, actuate the drive motor for an emergency opening of the lifting gate. The electrical energy storage thereby enables an emergency operation.

The drive system can advantageously further comprise a power regulating unit for actuating the drive motor, where the power regulating unit is adapted to recuperate the electrical energy generated during motor-driven deceleration of the gate panel and to charge the electrical energy storage with the recuperated energy. In this way, driving the lifting gate can be effected in an extremely energy-efficient manner, a characteristic that can be of importance, in particular, during accumulator-based emergency operations.

The control unit can advantageously further be adapted to determine an actual value on the basis of a signal supplied by the position sensor indicating a position or position change of the lifting gate, and to actuate the drive motor based on a comparison of the actual value with a reference value. It is in this manner possible to enable precise regulation of the gate motion. Based on a comparison of a reference value to an actual value, a reaction in the form of motion interruption can occur in the event of deviation.

In a further advantageous embodiment, the control device can monitor the residual accumulator charge and, when a predetermined lower threshold is reached, drive the gate panel into a secure and crash-safe position with the remainder of the energy. A further accumulator unit, provided as a redundant protection, can provide this energy. In an alternative embodiment, a mechanical brake can assume the function of this redundant protection. In the event that the gate panel remains in the stop position for a long time, the brake can be switched active for reasons of energy savings.

It can be verified by use of position sensor readings whether the holding position is maintained in a stable manner. If it is determined that the holding position is not maintained, then the drive motor is again energized for bringing about renewed holding at zero rotational speed or driving to a secure crash-safe position. In this case, a warning to inspect and repair the brakes can also be outputted.

Figure 3:
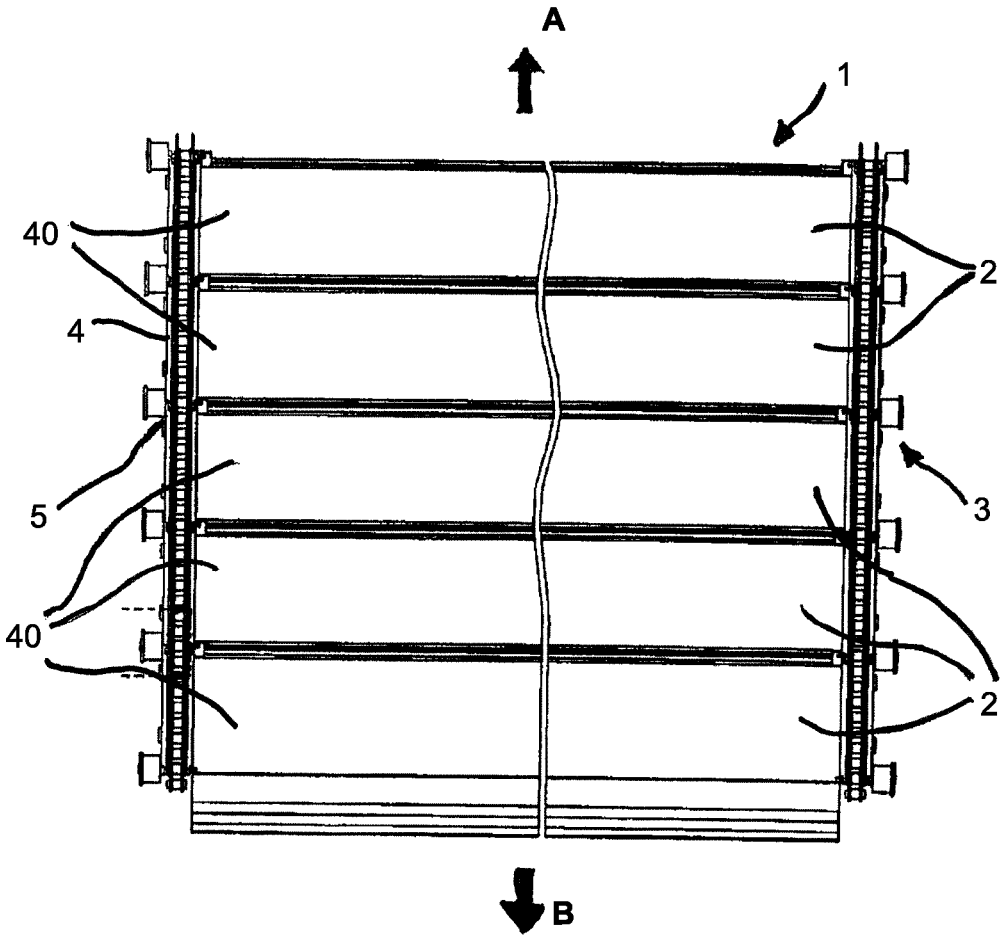
Figure 4:
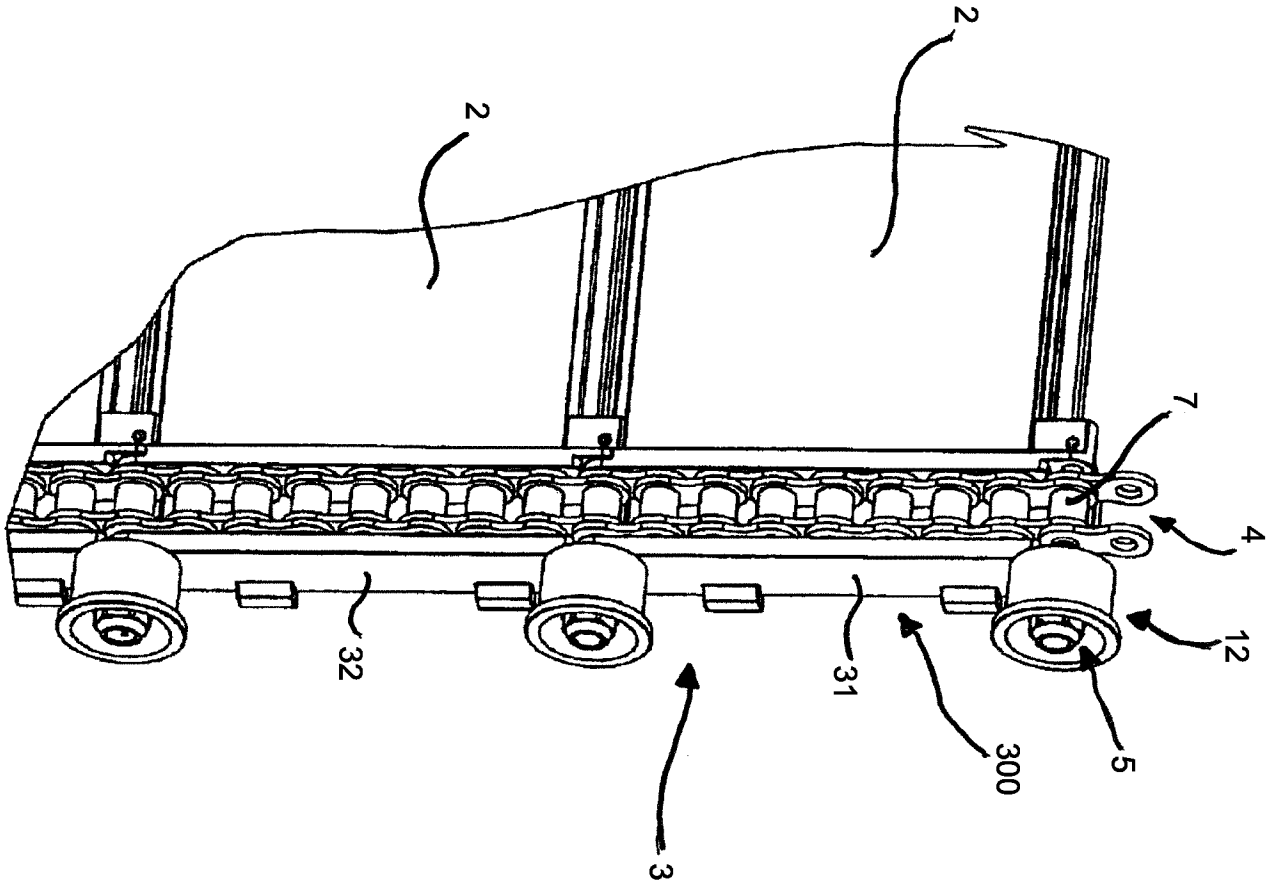
Figure 5:
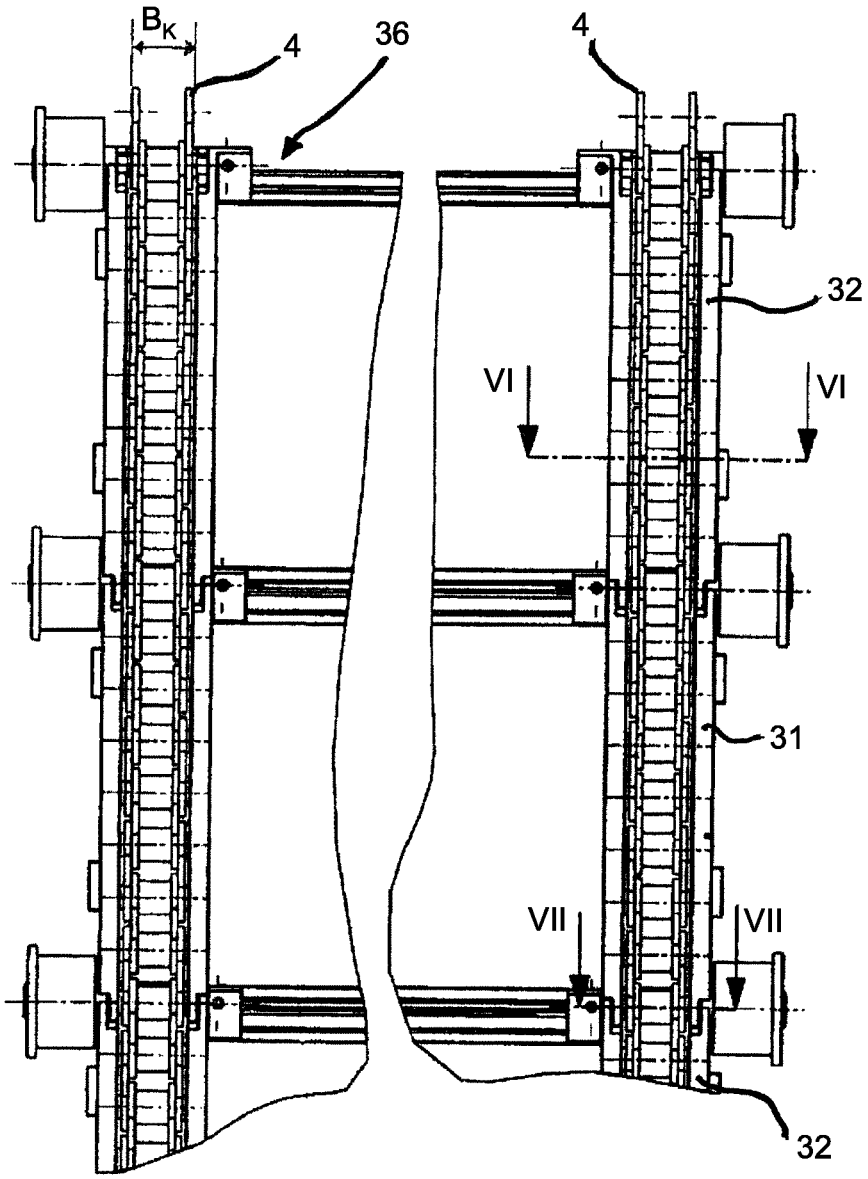
Figure 8:
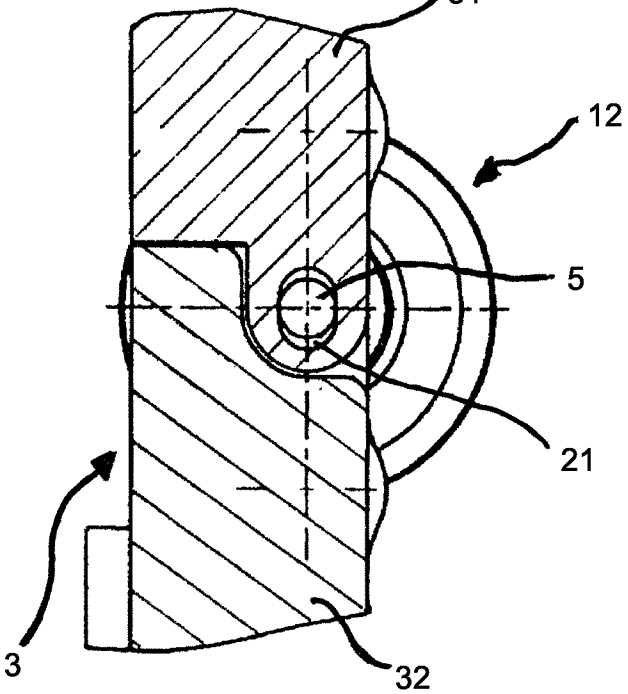
Figure 6:
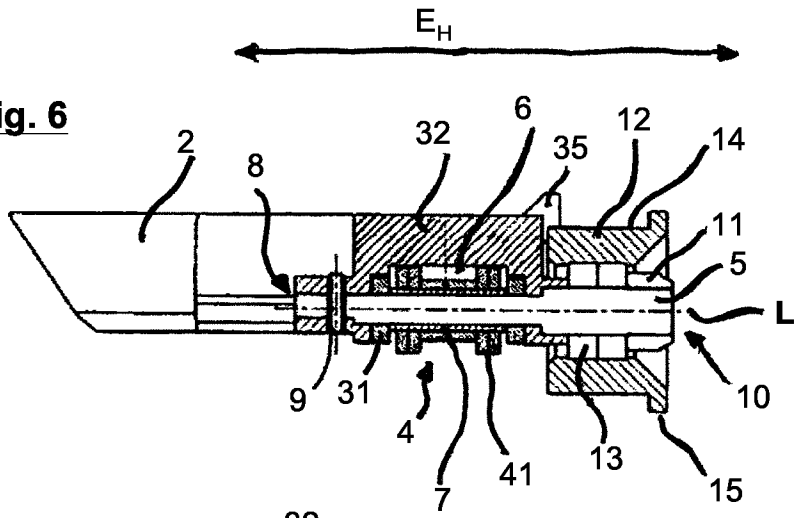
Figure 7:
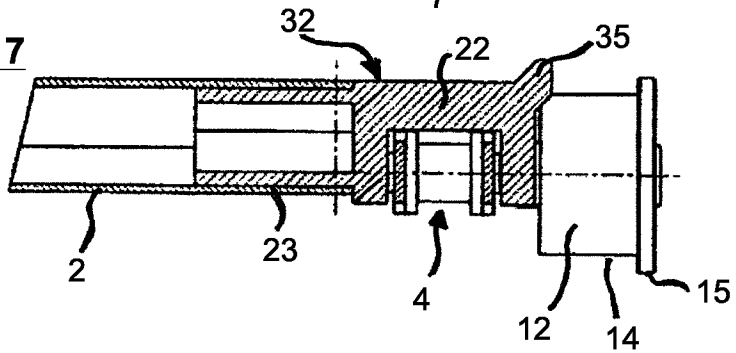
Figure 9:
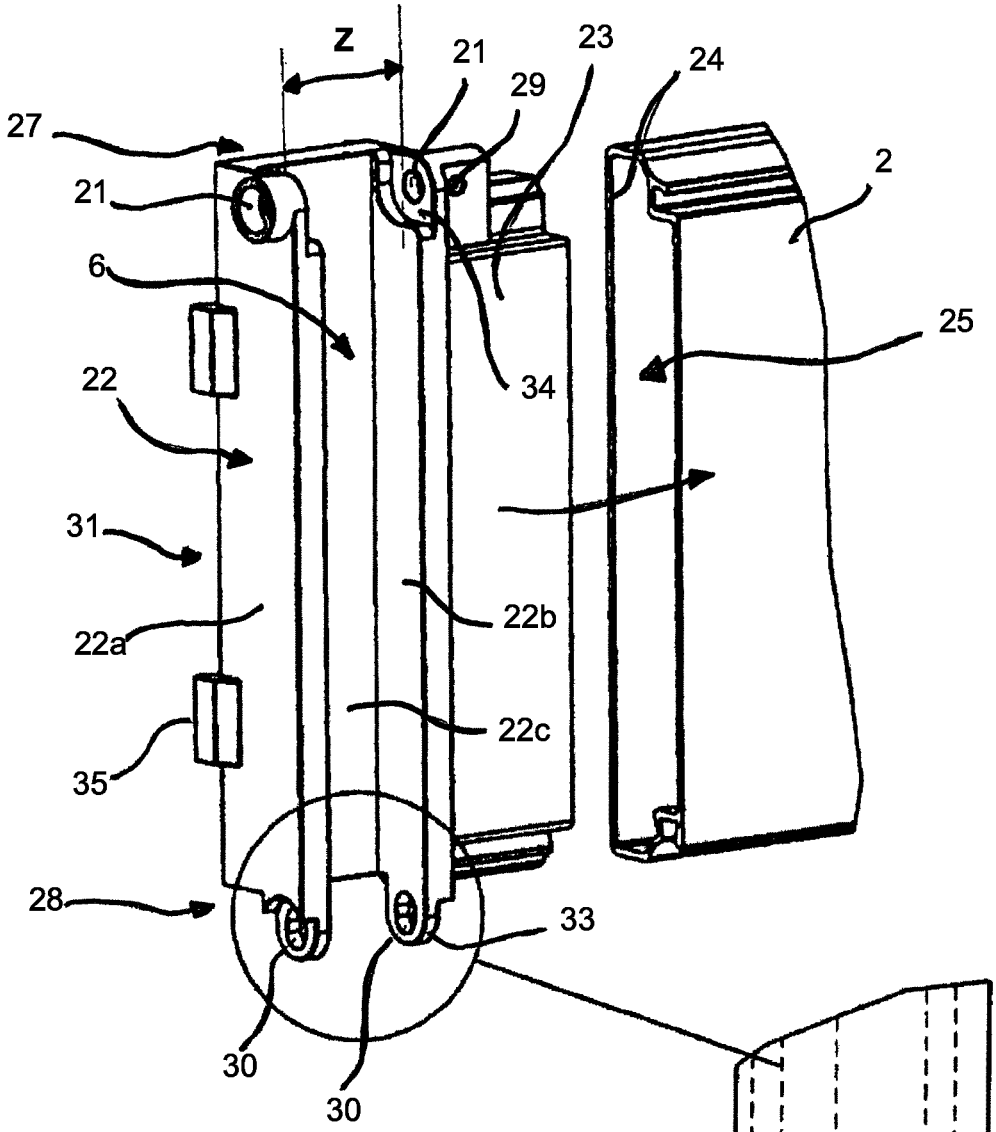
Figure 10:
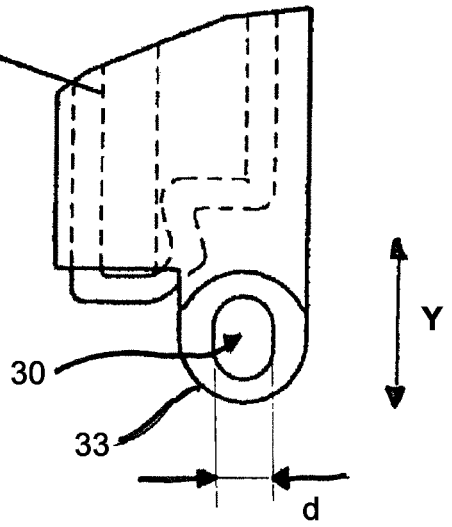
Figure 11:
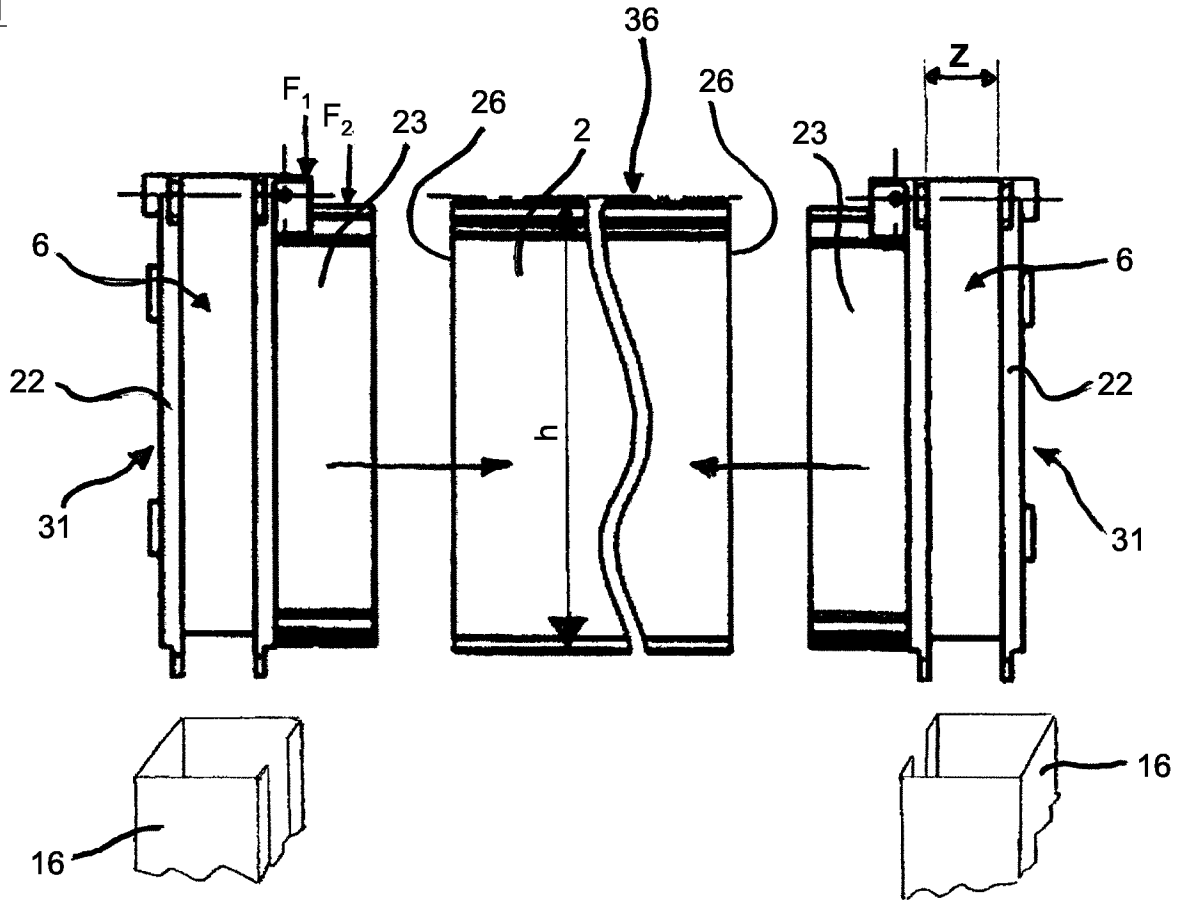
Figure 12:
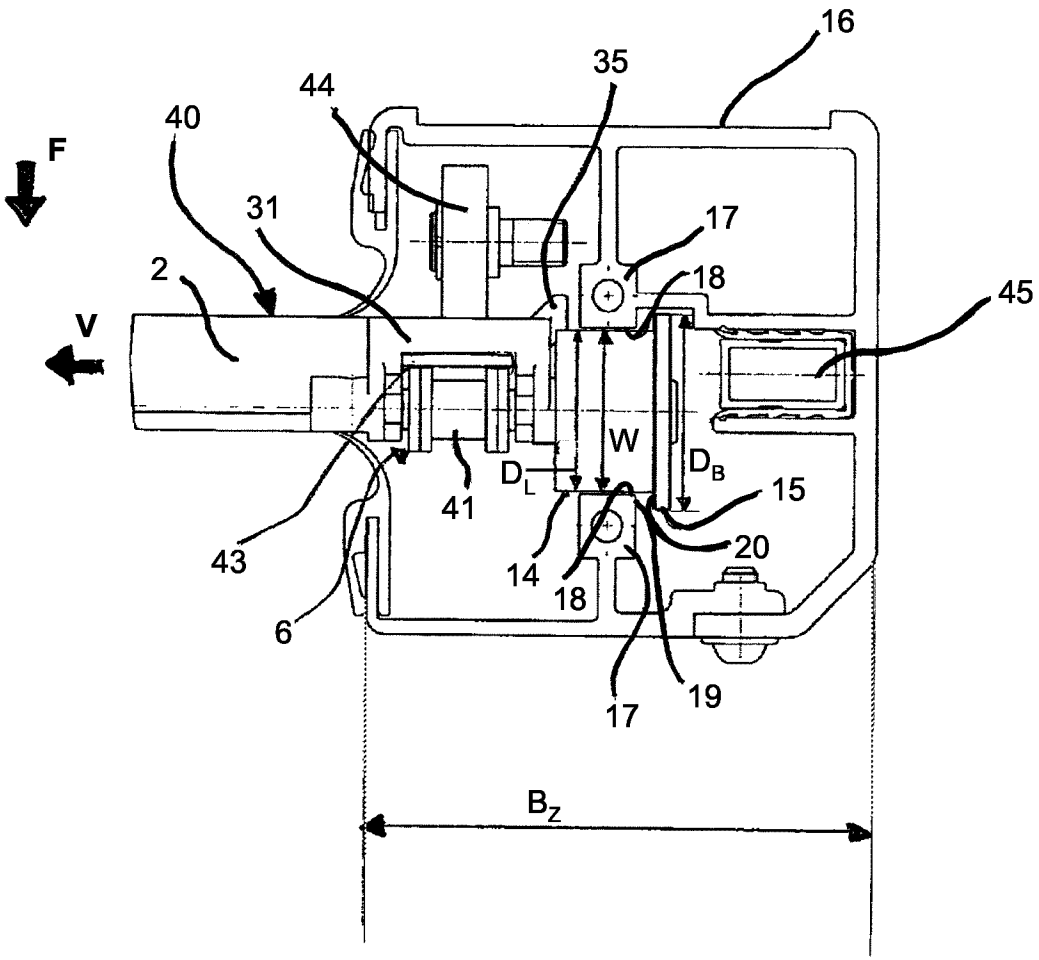
Figure 13:
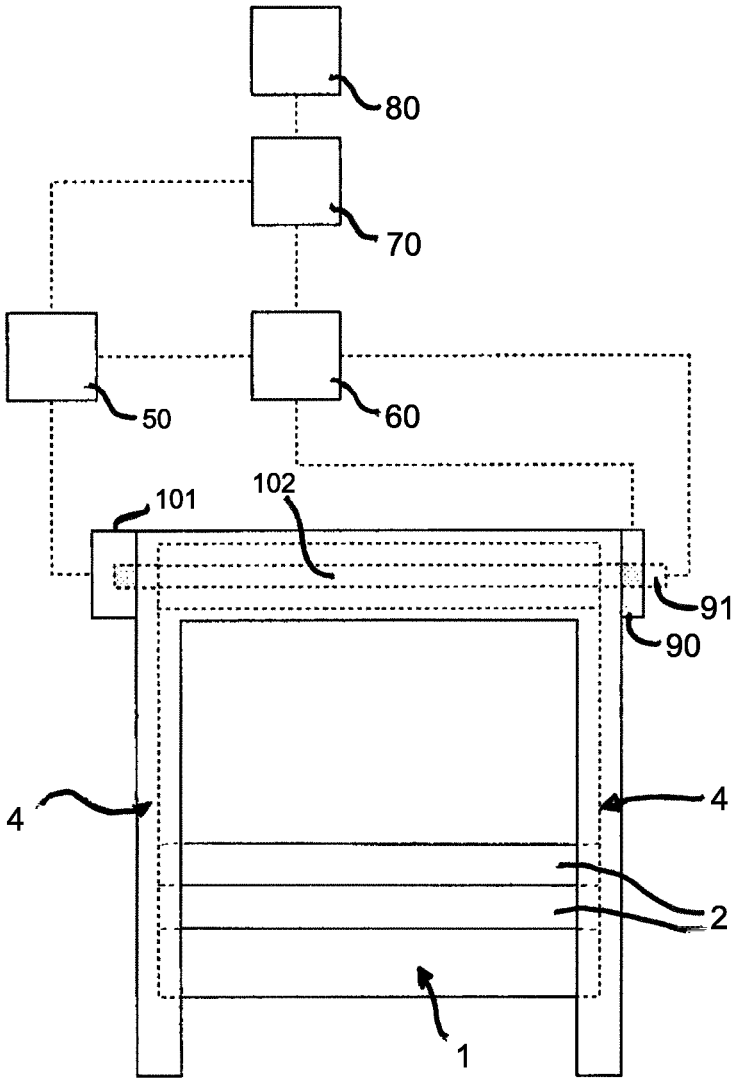
Figure 14:
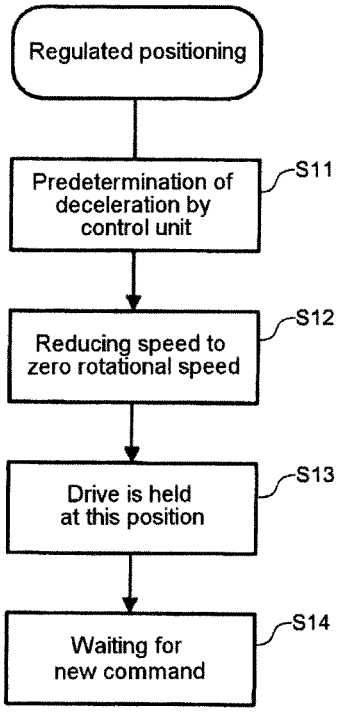
Figure 15:
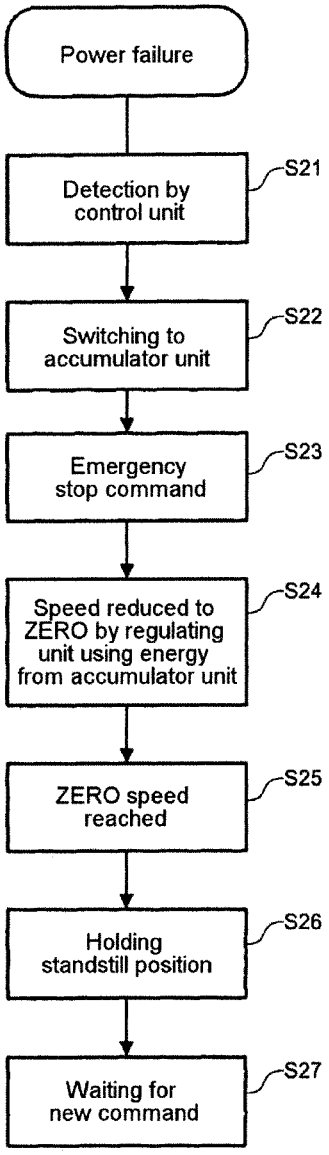
Figure 16:
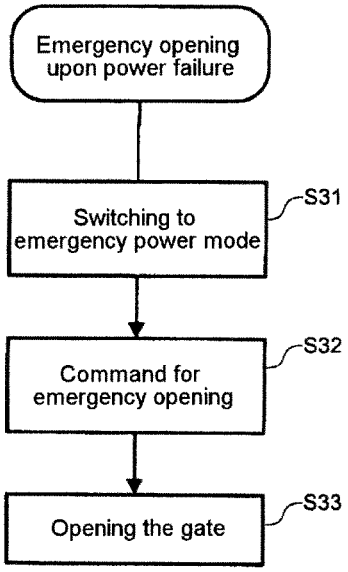
Figure 17:
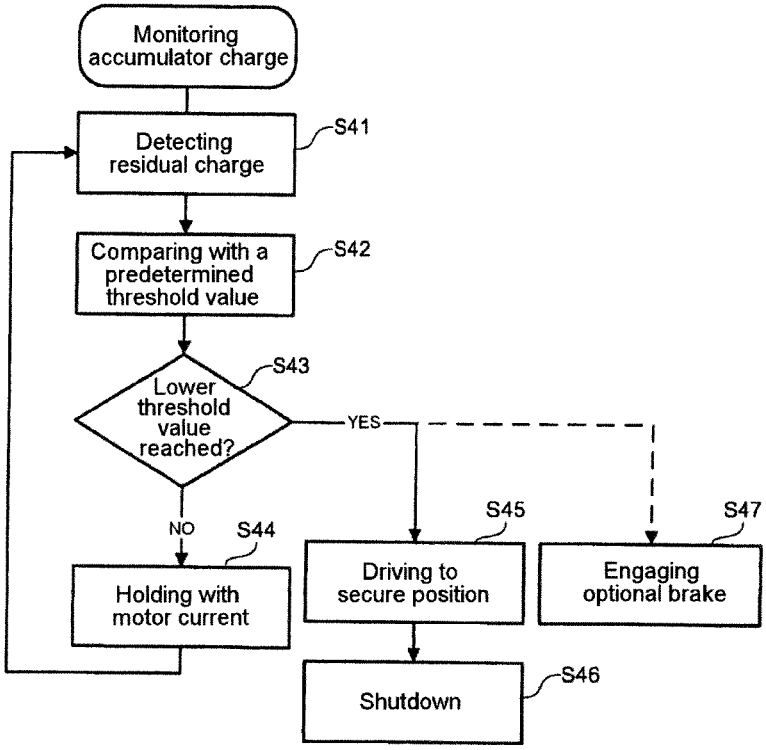
Figure 18:
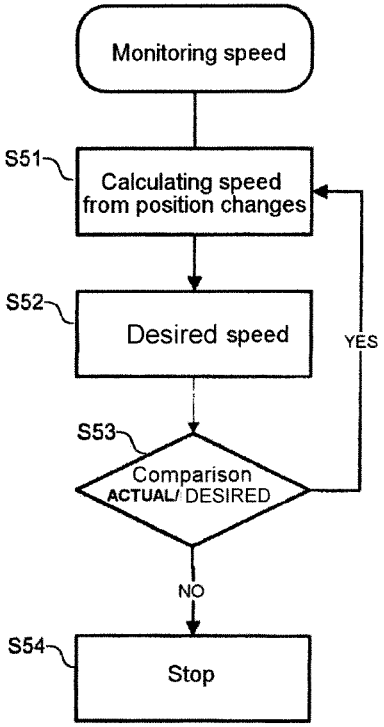
Figure 19:
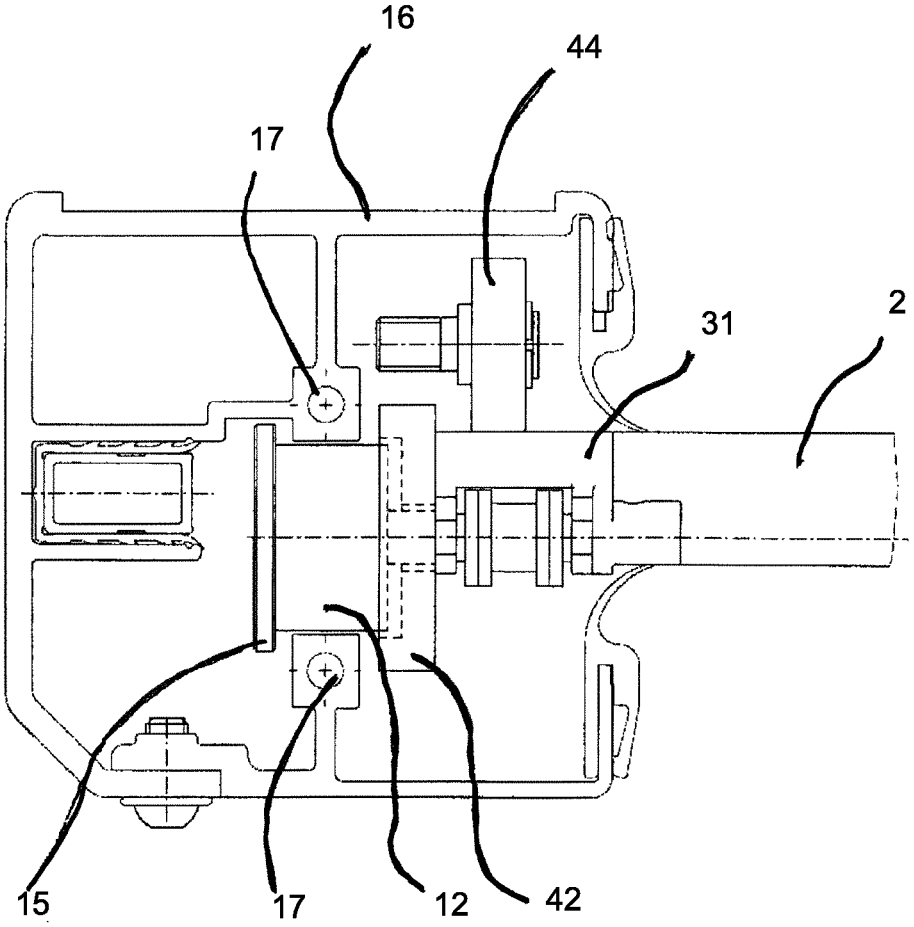
Figure 20:
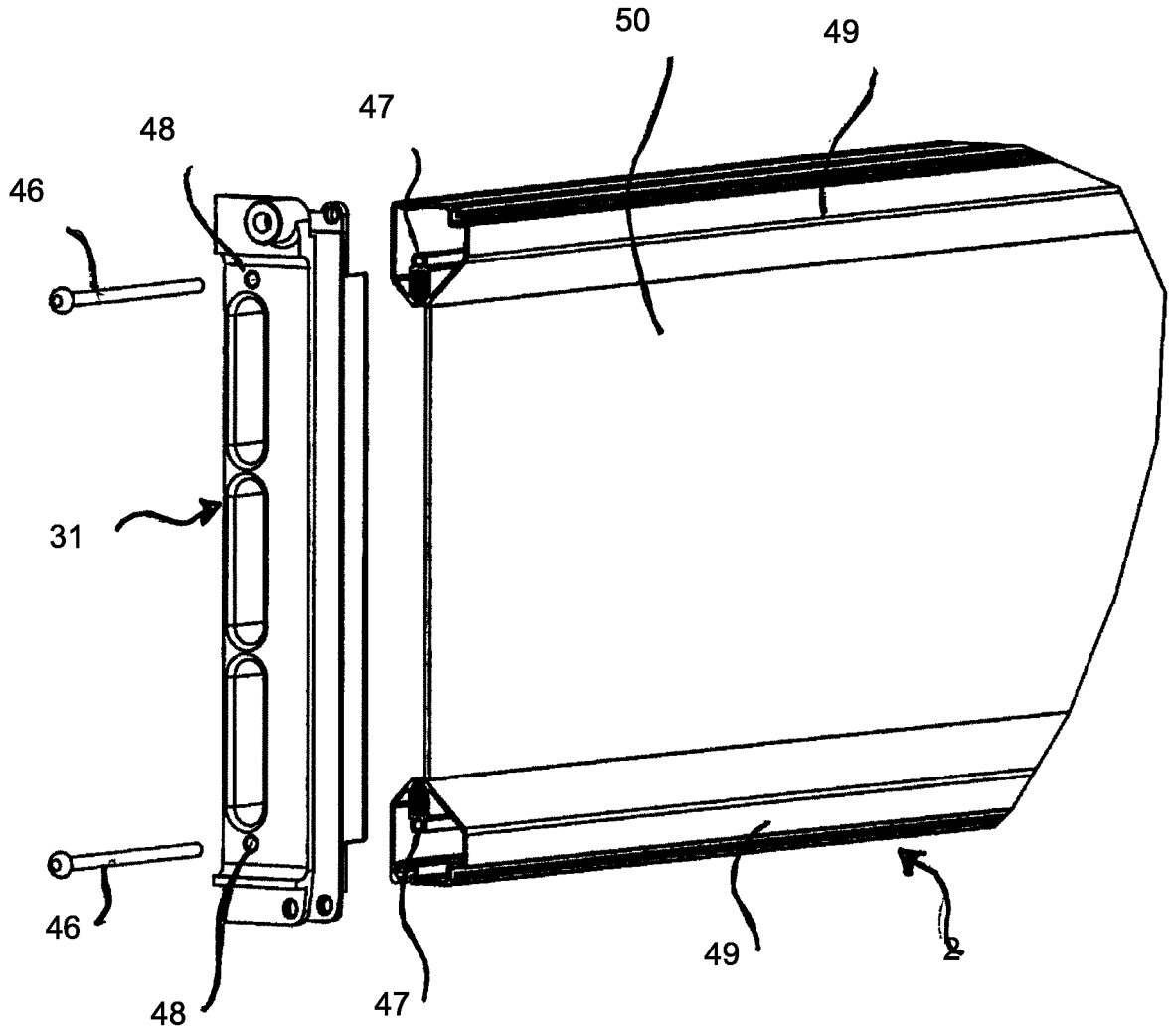

A possible embodiment of the invention is explained with reference to the drawing, where FIG. 1 shows a gate according to the invention in a front view with partially exposed elements, FIG. 2 shows the gate according to the invention from FIG. 1 in a schematic side view from the left, FIG. 3 shows a gate according to the invention in a front view, in which the undefined length of the gate panel segments is illustrated by dividing lines, FIG. 4 shows a detail of a gate according to the invention in a perspective view, FIG. 5 shows a detail of the gate according to the invention in a front view, in which the undefined length of the gate panel segments is illustrated by dividing lines, FIG. 6 shows a sectional view along the horizontal sectional line VI-VI in FIG. 5, FIG. 7 shows a sectional view along the horizontal sectional line VII-VII in FIG. 5, FIG. 8 shows a detail of a hinge of a gate according to the invention in a side view, FIG. 9 shows a perspective view of an individual hinge panel together with a detail of a gate panel segment of a gate according to the invention, FIG. 10 shows a detailed view of a portion of the hinge panel of FIG. 9, shown in a side view, FIG. 11 shows a schematic overview of a gate panel segment together with hinge panels in a front view, where the undefined length of the gate panel segment is illustrated by dividing lines, FIG. 12 shows a gate frame profile in a cross-sectional view with a gate panel segment arranged therein, FIG. 13 shows the schematic configuration of a lifting gate according to one embodiment of the present invention, FIG. 14 shows a schematic flow diagram illustrating the operation of the lifting gate according to the invention of FIG. 13, FIG. 15 shows a schematic flow diagram illustrating the operation of the lifting gate according to the invention of FIG. 13 in the event of power failure, FIG. 16 shows a schematic flow diagram illustrating the operation of the lifting gate according to the invention of FIG. 13 in the event of an emergency opening of the gate, FIG. 17 shows a schematic flow diagram illustrating the operation of the lifting gate according to the invention of FIG. 13 for monitoring the residual accumulator charge, and FIG. 18 shows a schematic flow diagram illustrating the operation of the lifting gate according to the invention of FIG. 13 for continuously monitoring the position and/or speed of the drive motor or of the gate panel, respectively, FIG. 19 shows a gate frame profile in a cross-sectional view with a gate panel segment arranged therein according to an alternative embodiment of the invention, FIG. 20 shows an exploded perspective view of a connection of a gate panel segment with a hinge panel according to a further alternative embodiment of the invention.

Identical or corresponding features are marked with identical reference symbols.

FIG. 1 shows a lifting gate according to the invention with a gate panel 1, which comprises several gate panel sections 40. Two adjacent gate panel sections 40 are each hingedly connected to one another by way of at least one hinge 3 (see FIG. 4).

The lifting gate also comprises a motor drive 100 for lifting and lowering gate panel 1 as well as a drive means in the form of a finite drive chain 4.

Motor drive 100 further comprises a drive motor 101 connected to drive chain 4.

Drive chain 4 is driven via a sprocket 104*a* which serves as a drive element. Sprocket 104*a* is moved by an output shaft 105*a* which is connected to motor output shaft 102 via a force transmission device, presently a toothed belt or a V-belt 107*a*. Belt 107*a* is further guided over two deflection rollers 106*a*, 106*b*. It is there possible to implement a step-up or step-down ratio of the force to be transmitted by way of the size of deflection rollers 106*a*, 106*b*.

Sprocket 104*a* is in engagement with chain 4 and can open and close the gate with its rotation. Provided in the vicinity of sprocket 104*a* and approximately opposite thereto is retaining roller 44, so that regions of gate panel sections 40 with the drive means 4 pass through between sprocket 104*a* and the retaining roller when the gate is opened and closed.

Motor output shaft 102 additionally drives an optional weight compensation device 200. In the embodiment shown in FIG. 1, motor output shaft 102 extends through weight compensation device 200 and again exits on an opposite side of the gate.

A second drive chain 4, which is driven via a second sprocket 104*b*, is located on this opposite side of the gate. Second sprocket 104*b* is moved by an output shaft 105*b* which is connected to motor output shaft 102 via a force transmission device, presently a toothed belt or a V-belt 107*b*. Belt 107*b* is further guided over two deflection rollers 106*c*, 106*d*. It is there possible to implement a step-up or step-down ratio of the force to be transmitted by way of the size of deflection rollers 106*c*, 106*d*.

Although not explicitly shown in FIG. 1, a drive motor can be provided also on this opposite side of the gate. It can be provided in addition to drive motor 101 or in place of drive motor 101. Motor output shaft 102 of illustrated drive motor 101 does not necessarily have to extend through weight compensation device 200.

The lifting gate comprises gate frames 16 on both sides. Gate frames 16 have a width $B_Z$ and co-determine the installation width of the gate. Drive chain 4 is disposed within this gate frame 16. Gate frame 16 forms the connecting point between the opening provided in a wall and the lifting gate. Gate frame 16 is shown in a cross-sectional view in FIG. 12 and has an opening 110 on the side facing gate panel 1 through which individual gate panel sections 40 are guided. Opening 110 can be sealed with sealing lips 112*a*, 112*b*.

With further reference to FIG. 12, the lifting gate comprises guide means that are arranged laterally on gate panel sections 40 and are presently designed as guide rollers 12. Guide rollers 12 serve to horizontally and/or vertically guide individual gate panel sections 40 during a motion (opening or closing) of gate panel 1.

FIG. 2 shows a side view, where gate panel 1 is shown schematically in dashed lines. Gate panel 1 is wound up along a spiral path 109. Spiral path 109 is arranged in the region of gate lintel 120. The depth T of gate lintel 120 decisively determines the installation depth of the gate.

FIG. 3 shows a further view of the gate according to the invention. The gate is vertically movable, where the gate is opened in the direction of arrow A and closed in the direction of arrow B.

Two adjacent gate panel sections 40 are each hingedly connected to one another by way of at least one hinge 3. Each gate panel section comprises a gate panel segment 2. As shown in FIG. 4, a hinge 3 comprises two hinge panels, namely a first hinge panel 31 and a second hinge panel 32 connected thereto in an articulated manner. Each gate panel segment 2 at its two opposite ends is respectively connected to a hinge panel (German: "Scharniergewerbe") 31, 32. Each gate panel section 40 comprises a gate panel segment 2 as well as the two hinge panels (German: "Scharniergewerbe") 31, 32 connected to the ends thereof. Alternatively, the hinge panels can also be arranged at other locations of the gate panel segments, for example, approximately centrally, or two gate panel sections with more than two hinges can be coupled to each other.

The gate according to the invention is moved by motor drive 100 between an open position and a closed position. The force required for lifting and lowering gate panel 1 is transmitted from motor drive 100 to gate panel 1 via at least one drive means, in the present embodiment via chain 4.

Connection mechanisms 5 connect chain 4 to gate panel 1. Several gate panel segments 2 are there each connected individually to chain 4. Connection mechanisms 5 are explained in more detail below with reference to FIG. 6.

FIG. 4 shows chain 4 serving as the drive means. This embodiment of the invention is a hollow pin chain, i.e. the individual links of chain 4 are connected to each other by hollow pins 7 For example, a connection mechanism 5 can extend through such a hollow pin 7.

As can be seen in FIG. 5, a chain 4 serving as a drive means can be located at the outward ends of gate panel 1. The gate can then be operated selectively with one or two drive means. Chain 4 is formed as a finite drive means. In other embodiments, however, an endless drive means can also be provided.

FIG. 6 shows a cross-sectional view along the sectional line VI-VI depicted in FIG. 5. A hinge panel 32 is shown, which is connected to a gate panel segment 2. Hinge panel 32 comprises a recess 6 in which chain 4 is accommodated. Chain 4 is inserted into recess 6 of the hinge panel 32 and is accommodated therein. In alternative embodiments, the drive means can be in part or completely accommodated in the gate panel segments.

In this embodiment, chain 4 and hinge 3 are connected via connection mechanism 5. A combined configuration can be realized, for example, by an integral formation of chain 4 and hinge 3. For example, hinge 3 can assume the function of chain 4, and chain 4 can also assume the function of hinge 3.

FIG. 6 shows a single chain link 41 with a hollow pin 7. A connection mechanism, presently a hinge pin 5, in its axial direction extends through hinge panel 32 and through hollow pin 7 of chain link 41. Hinge pin 5 is on one end 8, that faces gate panel segment 2, secured with a pin 9 against axially translational and radially rotational motions. Hinge pin 5 is fixed at the opposite end by a suitable device, presently a nut 11.

A guide roller 12 is rotatably mounted on hinge pin 5 by way of commercially available bearings 13. Guide roller 12 is arranged in the axial direction between nut 11 and hinge panel 32. Guide roller 12 comprises a running surface 14 and an externally disposed shoulder 15. Externally disposed shoulder 15 is spaced apart in the radial direction further from the center axis L of hinge pin 5 than running surface 14. Shoulder 15 serves as a horizontal guide for gate panel segments 2 during a vertical motion of gate panel 1.

FIG. 6 shows that the lifting gate further comprises at least one connection mechanism 5 for connecting drive chain 4 to at least one gate panel segment 2. It can also be seen in FIG. 6 that the laterally revolving drive means, i.e. chain 4, is disposed at least in sections between a gate panel segment 2 and a guide means, i.e. roller 12.

This arrangement of chain 4 between a gate panel segment 2 and a guide roller 12 within the present disclosure relates to a cross-sectional view, for example, as shown in FIG. 6, where positioning chain 4 is described relative to a horizontal direction of extension $E_H$. Chain 4 is therefore disposed along this horizontal direction of extension $E_H$ between a gate panel segment 2 and a guide roller 12.

FIG. 12 shows the arrangement according to the invention which is at least in part disposed in a gate frame profile 16. Gate frame profile 16 is shown in a cross-sectional view. It is a segmented hollow profile, in the interior of which at least two profile members 17 are located approximately symmetrically opposite to each other. The clear width W of the two profile members 17 is somewhat larger than the diameter $D_L$ at running surfaces 14 of guide roller 12. Guide roller 12 is arranged between the two profile members 17.

Profile members 17 comprise oppositely disposed running surfaces 18 which can bear against running surfaces 14 of guide roller 12. Due to this arrangement of guide roller 12 between two oppositely disposed profile members 17, guide roller 12, including gate panel segment 2 fastened thereto, is guided in its vertical direction of motion during a vertical motion of gate panel 1.

Shoulder 15 of guide roller 12 has a diameter $D_B$ which is greater than the diameter $D_L$ at running surfaces 14 of guide roller 12. The diameter $D_B$ of shoulder 15 is also greater than the clear width W of the two profile members 17. This results in a contact surface 20 on the inner side of shoulder 15 which can bear against an oppositely disposed contact surface 19 of profile members 17.

If, for example, a force F acts upon a gate panel segment 2, then this leads to flexing of gate panel segment 2 and therefore to a translational motion of gate panel segment 2 in the direction of motion arrow V. In such a case, shoulder 15 of guide roller 12 prevents guide roller 12 as well as gate panel segment 2 arranged thereon from slipping out from profile members 17 of gate frame profile 16. Gate panel segment 2 is thus guided approximately horizontally during a vertical motion of the gate.

A light barrier 45 is disposed on a side opposite to the opening of gate frame profile 16, by use of which it is possible to monitor whether the gate is in the open or closed state or whether an obstacle is blocking the path of open gate panel 2.

Disposed on the side of hinge panel 31 opposite to drive means 4 is a retaining roller 44 which is rotatably mounted on gate frame profile 16 and assumes the function of a guide. When gate panel 2 is opened and closed, retaining roller 44 rolls over the surface of hinge panel 31 which is disposed opposite to drive means 4 and with which retaining roller 44 is in contact.

Retaining roller 44 is located in the upper region of the closed gate panel in the region of the gate lintel in order to improve engagement of the sprocket with the drive means. It is also possible to provide several retaining rollers 44 on gate frame profile 16, for example, in the lower region of the closed gate or distributed over the height of the gate.

Provided in recess 6, in which chain links 41 of drive means 4 are received, between drive means 4 and a rear surface in recess 6, is a damper 43 with which both recess 6 as well as drive means 4 are in contact. Damper 43 can be fabricated from soft and/or elastic material, for example, from an elastomer.

FIG. 8 shows a hinge 3. Hinge 3 comprises a first hinge panel 31 and a second hinge panel 32. Both hinge panels 31, 32 each comprise an aligned bore 21 through which connection mechanism 5 extends. Connection mechanism 5 serves as a hinge pin 5 and forms an articulation axis about which hinge 3 can be pivoted in a known manner.

FIG. 9 shows a single hinge panel 31 by way of example. Hinge panel 31 comprises a guide section 22 on an outer lateral end side. Guide section 22 is composed of two vertical walls 22*a*, 22*b* and a horizontal wall 22*c* disposed therebetween which connects the two vertical walls 22*a*, 22*b*. The resulting U-shape forms a recess 6.

The clear width Z of recess 6 is slightly larger than the width $B_K$ of chain 4 (see FIG. 5). Chain 4 can be accommodated in recess 6 and can be inserted into recess 6. The horizontal movability of chain 4 is limited by the inner surfaces of recess 6, where chain 4 can move only until it contacts one of these surfaces.

Hinge panel 31 comprises a connection portion 23 which is on vertical wall 22*b* facing gate panel segment 2 and which is preferably formed integrally with guide section 22. Connection portion 23 has an outer shape which corresponds approximately to the inner hollow profile shape 24 of gate panel segment 2. A gate panel segment 2 can thus be pushed onto connection portion 23 in a fitting manner.

Hinge panel 31 is arranged in a cavity 25 of gate panel segment 2. In order to provide a reliable connection between hinge panel 31 and gate panel segment 2, hinge panel 31 is preferably glued to gate panel segment 2 in the region of connection portion 23 However, other forms of connection, such as, for example, screw connections, are not excluded.

As can be seen in FIG. 11, hinge panels 31, 32 can be mounted on both sides on a gate panel segment 2 in the manner described with reference to FIG. 9. Furthermore, FIG. 11 shows that the respective hinge panel 31, 32 is arranged on a face side end side 26 of gate panel segment 2 facing gate frame 16 and extends approximately over the entire height h of gate panel segment 2.

The individual hinge panels 31, 32 of a hinge 3 have the same external shape and are, in particular, approximately identical parts, preferably injection-molded parts. FIGS. 9 and 10 show that a hinge panel 31, 32 comprises a bore 21 at its one axial end 27 for receiving a hinge pin 5.

FIG. 6 shows an arrangement of this kind in a cross-sectional view, where a hinge pin 5 is guided through precisely these bores 21 of hinge panel 31.

The inside diameter of bore 21 is slightly larger than the outside diameter of hinge pin 5. The arrangement of hinge pin 5 in bore 21 realizes a fixed bearing with a rotational degree of freedom, i.e. hinge panel 31, 32 can rotate about hinge pin 5 with bore 21 provided at its one axial end.

In order to secure hinge pin 5 against twisting or displacement, a previously described pin 9 is inserted through a bore provided in hinge pin 5, which bore extends transversely to the longitudinal axis L of hinge pin 5. Pin 9 is further inserted through a transverse bore 29 (FIG. 9), which is produced in hinge panel 31 and preferably provided in connection portion 23.

FIGS. 8, 9 and 10 show that a hinge panel 31, 32 has a long hole 30 on its other axial side 28. Long hole 30 is a bore which is extended approximately in the direction of longitudinal direction of extension Y (FIG. 10). The inner diameter d of long hole 30 is slightly larger than the outer diameter of hinge pin 5. A floating bearing is thus realized, where, due to long hole 30, hinge panel 31, 32 is rotated both rotationally as well as translationally in the Y direction, i.e. along the direction of extension of long hole 30, about hinge pin 5.

As can best be seen in FIGS. 4, 5 and 8, the individual hinge panels 31, 32 can be connected to one another so that they form a hinge chain 300. Ends 27, 28 of a hinge panel 31, 32 are there shaped in such a way that they can be fitted with bores 21, 30 one over the other.

Recesses 34 are provided on the inner sides of bores 21 (FIG. 9) of a hinge panel 31, 32, into which fork ends 33 of an adjacent hinge panel 31, 32 can be fitted. Since hinge panels 31, 32 all have the same shape, the individual hinge panels 31, 32 can be assembled into an arbitrarily long hinge chain 300.

Each hinge panel 31, 32 has a lateral guide element 35 which is suitable to support and guide gate panel segment 2, which is connected to this hinge panel 31, 32, in a direction opposite to the horizontal direction V (FIG. 12) against profile member 17 during a vertical motion of gate panel 1. Lateral guide element 35 is arranged on the lateral outer side of first vertical wall 22*a* of guide section 22 of a hinge panel 31, 32.

FIG. 19 shows an alternative embodiment of gate panel 1 which comprises a sliding disk 42 serving as a sliding element. The type and perspective of the representation corresponds to the one already selected in FIG. 10, but for a horizontally oppositely disposed side of gate panel 1.

In this embodiment, gate panel 2 has no lateral guide element 35 and no damper 43. For lateral guidance of gate panel 2, a sliding disk 42 is provided between hinge panel 31 and guide roller 12 and is thus disposed opposite to shoulder 15 in the axial direction relative to guide roller 12. In the event of horizontal displacement of gate panel 2, sliding disk 42 can contact one or both of the profile members 17 and slide along them in order to limit the horizontal movability of gate panel 2. In the embodiment shown, sliding disk 42 is approximately round and provided with a center hole, where connection mechanism 5 extends through this hole, thereby fastening sliding disk 42.

Sliding disk 42 can be fabricated from low-friction and/or comparatively soft material in order to minimize frictional forces between sliding disk 42 and profile members 17 as well as the wear of the guide roller and profile members 17. In particular, if a sliding element 42 is provided on each of the two horizontally mutually oppositely disposed connection mechanisms 5 of a gate panel segment 2, horizontal guidance of guide rollers 12 can be effected substantially by sliding element 42.

Gate panel 2 can have several sliding elements 42 distributed over its height. For example, sliding elements 42 can always be arranged in pairs that are disposed horizontally opposite to each other. Such pairs of sliding elements 42 can be evenly distributed over the height of the closed gate panel, for example, with a total of three pairs at the upper end, at the lower end, and approximately at the center.

FIG. 20 shows an alternative embodiment of the connection between a gate panel segment 2 and a hinge panel 31 in an exploded view. In this embodiment, the gate panel segment is composed of two profile elements 49 and a cover 50 received between profile elements 49. Profile elements 49 can be made of metal, preferably aluminum. Numerous materials are also possible for the cover, for example, metals or plastic materials, preferably transparent plastic materials.

Profile elements 49 each comprise a screw hole 47 with an internal thread. In this embodiment, the hinge panel comprises two through bores 48, the spacing of which corresponds to the spacing of screw holes 47 of gate panel segment 2. The connection between hinge panel 31 and gate panel segment 2 can be established by screwing screws 46 through through bores 48 of hinge panel 31 and to screw holes 47 of profile elements 49.

The arrangement described with reference to the figures acts as follows:

Chain 4 is connected to motor 101 shown in FIGS. 1 and 13 via output shaft 102, belt 107, deflection rollers 106*a*, 106*b* and countershaft 105 by way of sprocket 104*a* and serves to drive the entire gate panel 1. Sprocket 104*a* extends in part into recesses 6 of the hinge panels and engages with chain 4 therein.

Gate panel 1 consists of several gate panel segments 2, where several of these gate panel segments 2, and preferably all gate panel segments 2, are connected to chain 4. Preferably, each gate panel segment 2 is fastened individually with a respective hinge pin 5 to chain 4.

The static weight forces as well as the dynamic forces occurring during operation are thus transmitted approximately uniformly at the respective connecting points formed by chain 4 and hinge pin 5 to the respective gate panel segment 2 connected thereto. The total force therefore no longer needs to be absorbed by the lowermost gate panel segment, but is distributed as uniformly as possible over the entire gate panel 1.

The forces $F_1$, $F_2$ (FIG. 11) required for lifting the individual gate panel segment 2 arise at the contact points of connection portion 23 with gate panel segment 2 and are transmitted mainly by chain 4. Hinge panels 31, 32 serve merely to connect individual gate panel segments 2 to one another in an articulated manner. Due to the special suspension of the individual hinge panels 31, 32 on hinge pin 5, only small forces arise at hinge panels 31, 32 themselves, in particular, in the region of their bores 21, 30, which are small to negligible as compared to the forces $F_1$, $F_2$ required for lifting gate panel 1.

The common connection between chain 4, hinge pin 5 and the individual hinge panels 31, 32 also causes chain 4 and the individual hinge panels 31, 32 to move substantially together. Long holes 30 serve, in particular, to exclude a static overdetermination of the system and thereby to compensate for tolerances or changes in length between chain 4 and hinge panels 31, 32.

It is there advantageous if hinge pins 5 are arranged in the upper half of a gate panel segment 2, and, in particular, in the region of an upper edge 36 of gate panel segment 2, as shown in FIGS. 3, 4 and 9. The individual gate panel segments 2 are then hanging vertically downwardly, following gravity.

A change in load in chain 4 and gate panel sections 2 arises only above the sprocket, i.e. in the region of gate lintel 120, in which gate panel 2 is supported in the open state, i.e. rolled up, where tensile and compressive forces arising between the gate panel sections when rolling up the gate panel are lower than those when lifting the gate panel 2 in the passage area.

Recess 6 formed in hinge panels 31, 32 serves as stable lateral guidance of chain 4 as well as protection of chain 4 from external influences. The arrangement of chain 4 in recess 6 also leads to a compact design which is further promoted by the fact that chain 4, inserted into hinge panels 31, 32, is arranged between gate panel segments 2 and a guide roller 12, where hinge pin 5 can simultaneously be used as the axis for this guide roller 12.

Damper 43 provided between chain 4 and recess 6 reduces the noise arising during the movement of gate panel 1, which can occur due to slight movements of chain 4 and hinge panels (hinge panel; "Scharniergewerbe") 31, 32. Another source of noise that damper 43 counteracts is the engagement of sprocket 53 with chain 4.

This compact design leads to the fact that the frame width $B_Z$ can be reduced as compared to prior art. Due to the frame width being reduced, the passage width of the gate can be increased.

The frame width $B_Z$ is furthermore kept small by the fact that drive 100 is at least in part arranged outside the gate frames. As shown in FIG. 1, at least motor 101, output shaft 102, deflection roller 106*a*, 106*b*, belt 107 and, at least in part shaft 105 are arranged outside gate frames 16.

Furthermore, the dimensions of the individual components can be kept small due to the favorable, i.e. approximately uniform, distribution of forces over the entire gate panel 1, as described with reference to FIGS. 1 to 12. These small dimensions, in particular, of drive 100, promote a compact design of the lifting gate according to the invention. In such "downsizing" of the drive, the use of synchronous motors of compact design is particularly advantageous. In addition to the gate frame width $B_Z$, also the installation space required for gate lintel 120, i.e. the installation depth T of the gate can thereby be kept compact.

The lifting gate according to the invention is shown schematically in FIG. 13, where gate panel 1 is operated by such a synchronous motor 101. Gate panel 1 is moved up and down by way of synchronous motor 101, output shaft 102 and drive means 4. The drive of gate panel 1 described above with reference to FIGS. 1 to 12 is operated by a power regulating unit 50 which makes it possible to perform the energized standstill operation of the motor in the manner described.

A logic and control unit 60 generates the control commands for the regulating unit based on command sensor signals and coordinates the modes of operation of the regulating unit with the other control components.

Instead of the end-to-end output shaft 102 presently illustrated schematically, the gate panel can also be received in separate spiral guide tracks 109 provided on both sides of the gate panel, as illustrated, for example, in FIG. 2.

The present invention is not restricted to the use of a synchronous motor as a drive motor. Instead of the synchronous motor, any motor can be used that can be regulated to zero rotational speed and at zero rotational speed also generates a sufficient amount of torque, like for example, stepping motors, reluctance motors, and the like.

FIG. 13 also shows an accumulator unit 70 which can be charged with recuperated energy. Furthermore, the accumulator unit can additionally be charged via an external power supply 80.

FIG. 13 also shows an electromechanical brake 90 acting upon the gate drive shaft and a position measuring system 91 embodied as an incremental encoder, absolute value transducer, or the like, which is also positioned directly on the shaft, where, ideally, both the brake as well as the position measuring system can be formed integrally with the drive.

The drive is actuated by a control unit such that its rotational speed (and therefore the speed of the gate panel) follows pre-set ramps. All moving parts are subject to approximately uniform accelerations. The mechanical loads on shafts and brakes are therefore reduced both during regular gate movement as well as during reversal and emergency stop operations, but also during power failures.

FIG. 14 shows a schematic flow diagram illustrating the operation of the lifting gate according to the invention of FIG. 13. In the event of a stop being requested, the motor is regulated quickly, reduced down to zero rotational speed and held at this position.

In step S11, a deceleration, with which the gate panel is to be braked, is predetermined by the control unit. In step S12, the gate panel drive is actuated on the basis of the predetermined deceleration in order to reduce the speed to zero rotational speed. The gate panel is then held at the position reached (step S13). The control unit then in step S14 waits for new commands.

FIG. 15 shows a schematic flow diagram illustrating the operation of the lifting gate according to the invention of FIG. 13 in the event of power failure. In the event of power failure, this is in step S21 detected by the control unit and interpreted as an (emergency) stop command (step S23). The control unit can for this be equipped with an appropriate monitoring device that continuously monitors the main power supply (e.g. grid voltage) and in the event of failure or interruption of the mains power supply switches to an emergency power supply (e.g. accumulator unit) (step S22).

The electrical energy stored in the accumulator unit is then used by the regulating unit by way of guided speed reduction to make the drive come to a controlled standstill (zero rotational speed) (step S24). Once the gate panel has reached zero speed (step S25), the gate panel is held at the standstill position by the energized drive (step S26). The control unit then in step S27 waits for new commands.

In the embodiment shown in FIG. 15, complex mechanical brakes for preventing gate panel crashes can be dispensed with despite power failure. The safety functions are assumed by controlled motor-driven braking of the gate panel by use of the energy stored in the accumulator unit.

Loss of the safety function due to mechanical brakes failing can thereby be ruled out.

FIG. 16 shows a schematic flow diagram illustrating the operation of the lifting gate according to the invention of FIG. 13 for performing an emergency opening of the gate during power failure.

The energy stored in the accumulator unit can be used in the absence of an external power supply to have the regulating unit perform controlled emergency opening of the gate. If the control unit detects that no external power supply is available, then it can switch to a so-called emergency power mode (step S31). Unneeded circuitry is then shut down in order to save energy.

If a command to perform an emergency opening is received in step S32, then the gate is opened in step S33. The control unit and the drive motor are supplied with electrical energy by the accumulator unit for this purpose, where the available power may well be less than with the external power supply.

The emergency mode speed is adjusted accordingly so that the accumulator capacity can be kept low. The emergency power program can be adapted to the existing residual capacity of the accumulator unit, so that preferably complete opening of the gate is achieved.

The emergency opening can be triggered in that a trigger button is manually operated, by a fire alarm system coupled thereto, or automatically during power failure. Other kinds of trigger mechanisms are conceivable.

FIG. 17 shows a schematic flow diagram illustrating the operation of the lifting gate according to the invention of FIG. 13 for monitoring the residual accumulator charge.

As already mentioned, the control device is configured in a favorable manner to monitor the residual accumulator charge and, when it drops below a predetermined lower threshold value, uses the remaining residual energy to move the gate panel to a secure position.

For this, the remaining residual charge in the accumulator unit is detected in step S41 and compared with a predetermined lower threshold value (step S42). As long as the threshold value is not reached, the motor current is maintained and the gate panel is held at the current position (step S44). If, however, the lower threshold value is reached, then the gate panel is taken to a secure position in step S45. Depending on the configuration, this can be a fully open or a fully closed position.

The lifting gate is then maintained unoperational in this position until power is restored (step S46). As a further optional measure to protect from failure of the accumulator unit, a holding brake can be activated (step S47). In addition, the control device can advantageously be configured such that a motion of the gate panel can be detected by the position data detection, while the holding brake is to prevent such motion, and the drive motor, in response to the detection of such a motion, is actuated with zero rotational speed in order to additionally hold the gate panel in a motor-driven manner.

Furthermore, the control unit can be configured to use the position data detection for a comparison of reference and actual speeds and to correct any deviation within a control loop or bring about a standstill. Hazardous motions can thereby be counteracted.

The electrical energy provided by the accumulator unit can also be used for the purpose of keeping the position data detection of the control unit running also during failure of the external power supply. It is thereby also possible in the emergency power mode to detect downwardly hazardous motions and to counteract the motion.

FIG. 18 shows a schematic flow diagram illustrating the operation of the lifting gate according to the invention of FIG. 13 for continuously monitoring the position and/or speed of the drive motor or of the gate panel, respectively.

The speed of the gate panel can be determined in step S51 via the changes in position of the gate panel or the gate panel drive that are detected by the position sensors. It is compared in step S53 with a predetermined desired speed (step S52).

If the actual speed and the desired speed match, then the method is continued in step S51. If the actual speed and the desired speed differ, then the gate panel can be halted in step S54, or an emergency stop can be initiated as described in the context of FIG. 2. By continuously monitoring the position and/or speed of the drive motor or the gate panel, respectively, a hazardous downwardly motion can be thus recognized and counteracted. The security against preventing a crash is thereby increased.

The invention claimed is:

1. A gate with a gate panel comprising:

several gate panel sections which are coupled to each other by way of hinges, where each of said hinges comprises two hinge panels of adjacent gate panel sections of the several gate panel sections, at least one elongated drive means which is connected to at least one of the several gate panel sections, at least one guide means which is configured to guide said gate panel during its motion, wherein each of the several gate panel sections are individually connected with the at least one elongated drive means, wherein said at least one elongated drive means is received at least in sections in said several gate panel sections, wherein each of the several gate panel sections includes a recess for receiving said at least one elongated drive means, where each recess of said the several gate panel sections is arranged in approximate alignment with each other recess of the several gate panel sections, wherein at least one of the several gate panel sections comprises a gate panel segment and one hinge panel of one of the hinges, and said at least one elongated drive means is embodied at least in sections between the gate panel segment and the at least one guide means, wherein further a connection mechanism is provided which connects at least one of the several gate panel sections to said at least one elongated drive means and to one of the at least one guide means, wherein said connection mechanism extends through two hinge panels of the hinges and is a hinge pin, and wherein a sliding element comprises a sliding disk arranged between at least one surface of a gate frame profile and at least one hinge panel, where said sliding disk is configured to be mounted on said connection mechanism.

2. The gate according to claim 1, characterized in that at least one said elongated drive means is at least one of a finite drive means and a chain.

3. The gate according to claim 1, characterized in that said at least one guide means comprises a guide roller which is rotatably mounted on said connection mechanism.

4. The gate according to claim 1, characterized in that two hinge panels of any of the hinges are formed in combination with said at least one elongated drive means.

5. The gate according to claim 1, characterized in that said at least one elongated drive means bears against at least one surface of one recess of the several gate panel sections, where movability of said at least one elongated drive means is limited by said recess approximately transversely to a direction of motion of said gate panel.

6. The gate according to claim 1, characterized in that a damper is provided between said at least one elongated drive means and at least one surface of one of the several gate panel sections and is suitable for damping a relative motion between said drive means and said hinge panel.

7. The gate according to claim 1, characterized in that at least one hinge panel of the two hinge panels comprises at least one lateral guide element which is adapted to regulate the movement of said hinge panels in the direction approximately transverse to an opening or closing motion of said gate panel.

8. The gate according to claim 1, characterized in that at least one hinge panel of the hinges includes the recess of one of the several gate panel sections and is arranged at least in part in a cavity of one gate panel segment forming one of the several gate panel sections and is connected substantially within said cavity to said one gate panel segment, where said at least one hinge panel and said one gate panel segment are connected to one another by adhesive bonding.

9. The gate according to claim 1, characterized in that one hinge panel of the two hinge panels includes the recess of one of the several gate panel sections and the other hinge panel of the two hinge panels is connected to a gate panel segment by way of a screw connection, where said gate panel segment comprises at least one bore with a thread and the one hinge panel comprises at least one through bore through which a screw extends.

10. The gate according to claim 1, further comprising a drive element forming a sprocket, the sprocket engaging with said at least one elongate drive means, and in that a guide is provided which holds said at least one elongated drive means in engagement with said drive element.

11. The gate according to claim 10, characterized in that said drive element extends at least in part into the recess included in one of the several gate panel sections.

12. The gate according to claim 10, characterized in that said guide comprises at least one counter bearing which forces said at least one elongated drive means in the direction of said drive element and is suitable for engaging with at least one of the two hinge panels.

13. The gate according to claim 10, characterized in that said guide comprises at least one retaining roller which is configured for rolling engagement with at least one of the two hinge panels.

* * * * *